US008036586B2

(12) United States Patent
Ichikawa et al.

(10) Patent No.: US 8,036,586 B2
(45) Date of Patent: Oct. 11, 2011

(54) DEVELOPER DELIVERING DEVICE AND IMAGE FORMING APPARATUS

(75) Inventors: Tomoya Ichikawa, Kanagawa (JP); Tatsuya Soga, Kanagawa (JP); Mihoko Tanaka, Kanagawa (JP); Satoshi Shigezaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/549,940

(22) Filed: Aug. 28, 2009

(65) Prior Publication Data

US 2010/0247191 A1 Sep. 30, 2010

(30) Foreign Application Priority Data

Mar. 24, 2009 (JP) ..... P2009-072682

(51) Int. Cl.
*G03G 21/10* (2006.01)
*G03G 15/08* (2006.01)

(52) U.S. Cl. ..... 399/358; 399/256

(58) Field of Classification Search ..... 399/358, 399/359, 360, 254, 256, 258, 261, 101
See application file for complete search history.

(56) References Cited

U.S. PATENT DOCUMENTS 5,933,690 A * 8/1999 Sugimoto et al. ..... 399/358 X
7,221,880 B2 * 5/2007 Jeong et al. ..... 399/358 X
2008/0118290 A1 5/2008 Sato

FOREIGN PATENT DOCUMENTS

JP 2007-279264 10/2007
JP 2007-310410 A * 11/2007
JP 2008-129345 6/2008
JP 2008-268574 A * 11/2008

* cited by examiner

*Primary Examiner* — Sophia S Chen
(74) *Attorney, Agent, or Firm* — Morgan, Lewis & Bockius LLP

(57) ABSTRACT

The developer delivering device includes a first delivering path, a second delivering path, a helical delivering blade disposed in the second delivering path, and a developer breaking member disposed in a connecting portion of the first delivering path and the second delivering path. The developer breaking member includes a breaking portion disposed opposite to a side wall of the second delivering path in a developer delivering direction of the second delivering path, a contact portion that is in contact with the helical delivering blade and extended in the developer delivering direction between the breaking portion and a center of the rotation of the helical delivering blade, and a coupling portion. The breaking portion has a first breaking portion and a second breaking portion. The contact portion has a first contact portion and a second contact portion. The coupling portion couples the first contact portion to the second contact portion.

13 Claims, 11 Drawing Sheets

DEVELOPER DELIVERING DEVICE AND IMAGE FORMING APPARATUS

CROSS-REFERENCE TO RELATED APPLICATIONS

This application is based on and claims priority under 35 USC 119 from Japanese Patent Application No. 2009-072682 filed on Mar. 24, 2009.

BACKGROUND

1. Technical Field

The present invention relates to a developer delivering device and an image forming apparatus.

2. Related Art

In a related-art electrophotogaphic type image forming apparatus such as a copying machine or a printer, a residue such as a developer, a corona product or paper powder which remains on a surface of an image holding member in a formation of an image is collected and delivered.

SUMMARY

According to an aspect of the invention, there is provided a developer delivering device including:

a first delivering path through which a developer is delivered;

a second delivering path through which the developer is delivered, the second delivering path being disposed on a downstream of the first delivering path;

a helical delivering blade that is disposed in the second delivering path and delivers the developer by a rotation; and a developer breaking member that is disposed in a connecting portion of the first delivering path and the second delivering path and includes a breaking portion that is disposed opposite to a side wall of the second delivering path in a developer delivering direction of the second delivering path, a contact portion that is in contact with the helical delivering blade and extended in the developer delivering direction between the breaking portion and a center of the rotation of the helical delivering blade, and a coupling portion, the breaking portion having a first breaking portion disposed opposite to one of the side walls of the second delivering path, and a second breaking portion disposed opposite to the other side wall of the second delivering path, the contact portion having a first contact portion extended in the developer delivering direction between the first breaking portion and the center of the rotation of the delivering blade, and a second contact portion extended in the developer delivering direction between the second breaking portion and the center of the rotation of the delivering blade, the coupling portion coupling the first contact portion to the second contact portion.

BRIEF DESCRIPTION OF THE DRAWINGS

Exemplary embodiments of the invention will be described in detail based on the following figures, wherein.

DETAILED DESCRIPTION

Figure 1:
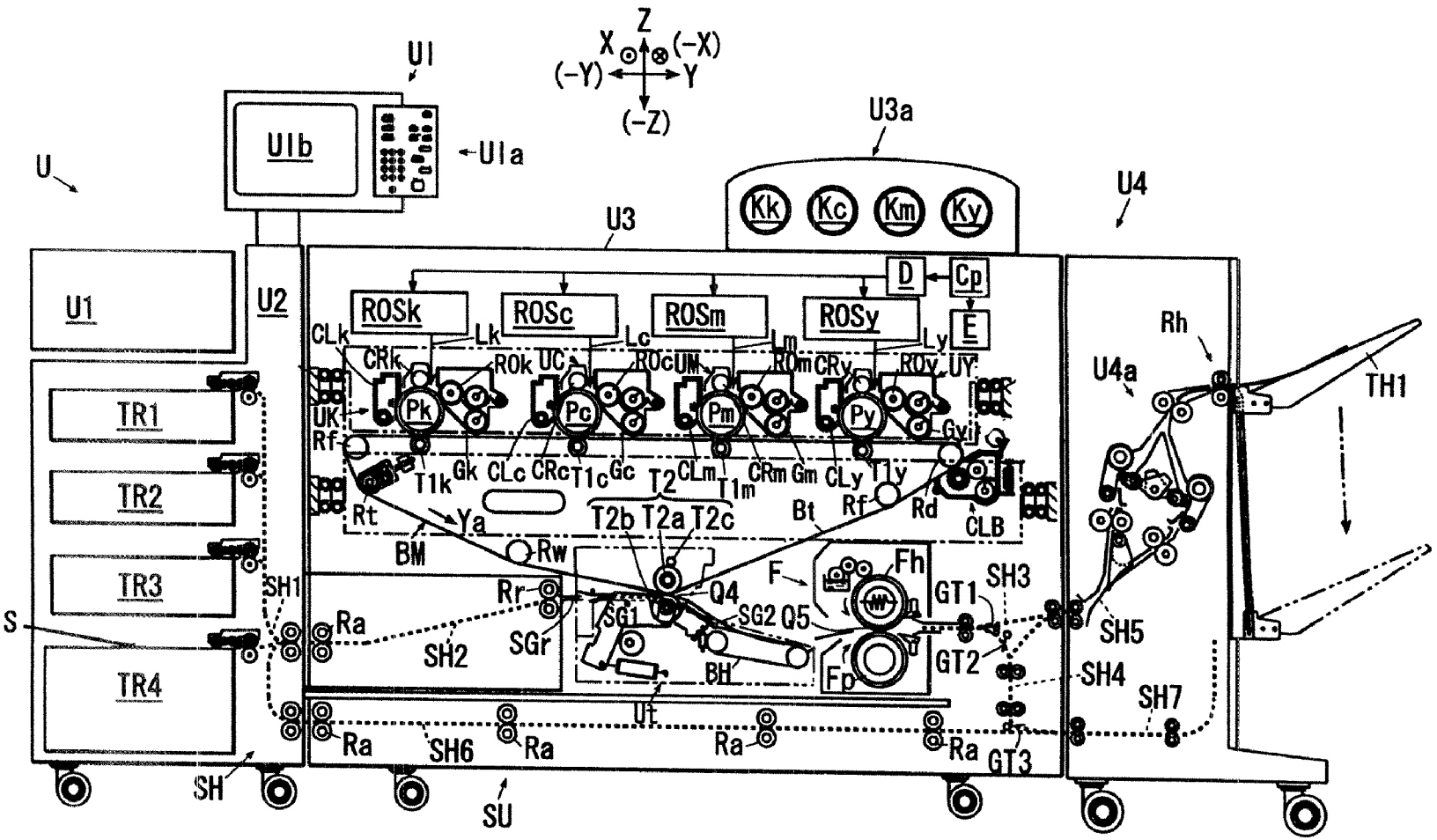
FIG. 1 is a general explanatory view showing an image forming apparatus according to a first exemplary embodiment of the invention.

Next, exemplary embodiments of the invention will be described with reference to the drawings, and the invention is not restricted to the following embodiments.

In order to easily understand the following description, in the drawings, a longitudinal direction is set to be an X-axis direction, a transverse direction is set to be a Y-axis direction, a vertical direction is set to be a Z-axis direction, and directions or sides shown in arrows X, −X, Y, −Y, Z and −Z are set to be forward, rearward, rightward, leftward, upward and downward directions or front, rear, right, left, upper and lower sides, respectively.

Moreover, "." described in a circle indicates an arrow from a back side toward a right side of a paper, and "x" described in a circle indicates an arrow from the right side toward the back side of the paper.

In the following explanation using the drawings, members other than necessary members for the explanation will be properly omitted for easy understanding.

First Exemplary Embodiment

FIG. 1 is a general explanatory view showing an image forming apparatus according to a first exemplary embodiment of the invention.

In FIG. 1, a copying machine U according to an example of the image forming apparatus has an operating portion UI, an image inputting device U1, a medium supplying device U2, an image forming apparatus body U3, and a paper processing device U4. In the first exemplary embodiment, the image inputting device U1, the medium supplying device U2, the image forming apparatus body U3 and the paper processing device U4 are constituted removably from each other.

(Operating Portion)

The operating portion UI has an inputting key UIa to be used for starting a copying operation or setting the number of copies. Moreover, the operating portion UI has a displaying device UIb for displaying contents input through the inputting key UIa or a state of the copying machine U.

(Image Inputting Device)

The image inputting device U1 is constituted by an automatic document delivering device and an image reading device, and irradiates a light onto a document which is disposed, receives a reflected light by means of a CCD, converts the light into image information about red: R, green: G and blue: B, and inputs the same image information to the image forming apparatus body U3 at a preset time in a so-called preset timing.

(Medium Supplying Device)

The medium supplying device U2 has plural paper feeding trays TR1, TR2, TR3 and TR4 according to an example of a medium housing container. Moreover, the medium supplying device U2 has a medium supplying path SH1 for taking out a recording paper S according to an example of an image recording medium which is accommodated in each of the paper feeding trays TR1 to TR4 and delivering the recording paper S to the image forming apparatus body U3.

(Image Forming Apparatus Body)

In FIG. 1, the image forming apparatus body U3 has an image recording portion for recording an image on the recording paper S delivered from the medium supplying device U2, a developer supplying device U3*a*, a paper delivering path SH2, a paper discharging path SH3, a paper inverting path SH4 and a paper circulating path SH6.

Moreover, the image forming apparatus body U3 has a control portion Cp, and a laser driving circuit D and a power circuit E according to an example of a latent image forming apparatus driving circuit which are controlled by the control portion Cp. The laser driving circuit D converts the image information about the red R, the green G and the blue B input from the image inputting device U1 into image information about Y: yellow, M: magenta, C: cyan and K: black, and outputs a driving signal corresponding thereto to latent image forming devices ROSy, ROSm, ROSc and ROSk for the respective colors in a preset timing.

Figure 2:
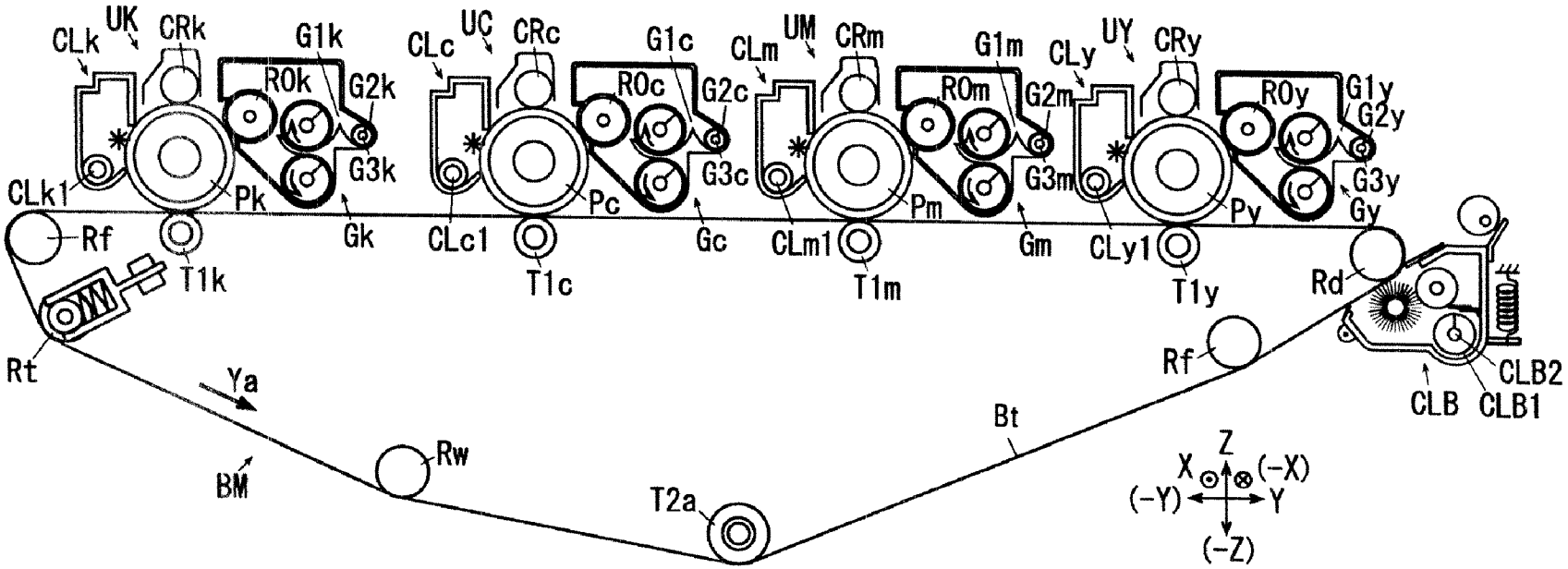
FIG. 2 is an enlarged explanatory view showing a visible image forming device and an intermediate transferring member cleaning device.

FIG. 2 is an enlarged explanatory view showing a visible image forming device and an intermediate transferring member cleaning device.

In FIGS. 1 and 2, photosensitive units UY, UM, UC and UK which can be attached/removed to/from the image forming apparatus body are disposed below the latent image forming devices ROSy, ROSm, ROSc and ROSk for the respective colors.

The K-color photosensitive unit UK has a photosensitive drum Pk according to an example of an image holding member on which a toner image according to an example of an electrostatic latent image or a visible toner image is formed, a charging roll CRk according to an example of a charger, and a photosensitive cleaner CLk according to an example of the image holding member cleaning device. A change into a unit indicates that plural members can be attached/removed to/from the integral apparatus body.

A developing device Gk according to an example of a developing unit is disposed on a right side of the photosensitive unit UK. The developing device Gk is disposed opposite to the photosensitive drum Pk and has, on a surface, a developing roll R0*k* according to an example of a developer holding member which serves to hold and rotate a developer, and develops a latent image on a surface of the photosensitive drum Pk into a visible image.

For the other colors Y, M and C, similarly, there are provided the photosensitive units UY, UM and UC having photosensitive drums Py, Pm and Pc, charging rolls CRy, CRm and CRc and cleaners CLy, CLm and CLc, and developing devices Gy, Gm and Gc having developing rolls R0*y*, R0*m* and R0*c*.

A K-color visible image forming device (UK+Gk) is constituted by the K-color photosensitive unit UK and the developing device Gk having the developing roll R0*k*. Similarly, Y-, M- and C-color visible image forming devices (UY+Gy), (UM+Gm) and (UC+Gc) are constituted by the Y-, M- and C-color photosensitive units UY, UM and UC and the developing devices Gy, Gm and Gc having the developing rolls R0*y*, R0*m* and R0*c*, respectively.

The photosensitive units UY, UM, UC and UK and the developing devices Gy, Gm, Gc and Gk are removably attached to the image forming apparatus body U3.

In FIG. 1, the surfaces of the rotated photosensitive drums Py, Pm, Pc and Pk are uniformly charged by means of the changing rolls CRy, CRm, CRc and CRk respectively, and electrostatic latent images are then formed on the surfaces of the rotated photosensitive drums Py, Pm, Pc and Pk through laser beams Ly, Lm, Lc and Lk according to an example of latent image writing lights output from the latent image forming devices ROSy, ROSm, ROSc and ROSk. The electrostatic latent images formed on the surfaces of the photosensitive drums Py, Pm, Pc and Pk are developed into toner images according to an example of visible images having colors of Y: yellow, M: magenta, C: cyan and K: black by means of the developing devices Gy, Gm, Gc and Gk.

In the developing devices Gy to Gk, a developer consumed by a development is supplied from toner cartridges Ky, Km, Kc and Kk according to an example of developer housing containers to be attached removably to the developer supplying device U3*a*. In the first exemplary embodiment, a two-component developer containing a toner and a carrier is used as the developer, and so-called high concentration developers having higher toner rates than toner concentrations of the developing devices Gy to Gk are supplied from the toner cartridges Ky, Km, Kc and Kk. In the developing devices Gy to Gk according to the first exemplary embodiment, accordingly, a developer containing a deteriorated carrier is discharged from the developing devices Gy to Gk little by little to exchange the carrier while a high concentration developer containing a carrier in a small amount is supplied. Since the technique for exchanging the carrier little by little has been well-known and has been described in JP-A-2000-81787 Publication and JP-A-2003-84570 Publication, for example, detailed description will be omitted.

In the developing devices Gy to Gk, the developer containing the deteriorated carrier is discharged from deteriorated developer discharging ports G1*y* to G1*k* to rear ends of the developing devices Gy to Gk, and furthermore, a new developer containing a carrier is supplied from each of the toner cartridges Ky to Kk. Consequently, the developer in each of the developing devices Gy to Gk is exchanged with the new developer little by little. The developer discharged from the deteriorated developer discharging ports G1*y* to G1*k* flows into deteriorated developer delivering paths G2*y* to G2*k* extended rearward and is delivered rearward by means of deteriorated developer delivering members G3*y* to G3*k* disposed in the deteriorated developer delivering paths G2*y* to G2*k*.

The toner images formed on the surfaces of the photosensitive drums Py, Pm, Pc and Pk are sequentially superposed and transferred onto an intermediate transferring belt Bt according to an example of an intermediate transferring member by means of primary transferring rolls T1*y*, T1*m*, T1*c* and T1*k* according to an example of a primary transferring device so that a multicolor image is formed on the intermediate transferring belt Bt. A color toner image according to an example of a multicolor visible image formed on the intermediate transferring belt Bt is delivered to a secondary transferring region Q4.

In case of only the K-color image information, only the K-color photosensitive drum Pk and the developing device Gk are used and only a K-color toner image is formed.

After a primary transfer, a residue such as a residual developer or a corona product which is stuck to the surfaces of the photosensitive drums Py, Pm, Pc and Pk is removed by means of the cleaners CLy, CLm, CLc and CLk.

A belt module BM according to an example of an intermediate transferring device is supported below the respective visible image forming devices (UY+Gy), (UM+Gm), (UC+Gc) and (UK+Gk).

The belt module BM has the intermediate transferring belt Bt. The intermediate transferring belt Bt is supported rotatably and movably in a direction of an arrow Ya by means of a belt supporting roll (Rd+Rt+Rw+Rf+T2*a*) according to an example of an intermediate transferring member supporting member which is constituted by a driving roll Rd according to an example of an intermediate transferring member driving member, a tension roll Rt according to an example of a tension generating member, a walking roll Rw according to an example of a meander preventing member, plural idler rolls Rf according to an example of a driven member, and a backup roll T2*a* according to an example of a secondary transfer opposing member.

The belt module BM according to the first exemplary embodiment is constituted by the intermediate transferring belt Bt, the belt supporting roll (Rd+Rt+Rw+Rf+T2*a*), and the primary transferring rolls T1*y*, T1*m*, T1*c* and T1*k*.

A secondary transferring unit Ut is disposed below the backup roll T2*a*. The secondary transferring unit Ut has a secondary transferring roll T2*b* according to an example of a secondary transferring member. The secondary transferring roll T2*b* is disposed to enable a separation/pressure contact from/with the backup roll T2*a* with the intermediate transferring belt Bt interposed therebetween, and the secondary transferring region Q4 is formed by a region in which the secondary transferring roll T2*b* comes in pressure contact with the intermediate transferring belt Bt. Moreover, a contact roll T2*c* according to an example of a contact power feeding member comes in contact with the backup roll T2*a*. A secondary transferring voltage having the same polarity as a charging polarity of a toner is applied in a preset timing from the power circuit E controlled by the control portion Cp to the contact roll T2*c*.

A secondary transferring device T2 is constituted by the backup roll T2*a*, the secondary transferring roll T2*b* and the contact roll T2*c*.

Although a transferring part (BM+T2) according to the first exemplary embodiment is constituted by the belt module BM and the secondary transferring device T2, moreover, it is also possible to carry out a direct transfer from a photosensitive member onto a paper, for example.

The paper delivering path SH2 is disposed below the belt module BM. The recording paper S supplied from the medium supplying path SH1 of the medium supplying device U2 is delivered to a resist roll Rr according to an example of a time adjusting member of the paper delivering path SH2 by means of a medium delivering roll Ra according to an example of a medium delivering member. The resist roll Rr delivers the recording paper S to a downstream side in a timing for delivering a color toner image formed on the intermediate transferring belt Bt to the secondary transferring region Q4, and the recording paper S is guided by means of a resist guide SGr and a pretransferring guide SG1 and is thus delivered to the secondary transferring region Q4.

The color toner image formed on the intermediate transferring belt Bt is transferred onto the recording paper S by means of the secondary transferring device T2 when passing through the secondary transferring region Q4. In case of a multicolor image, the toner images superposed and transferred primarily onto the surface of the intermediate transferring belt Bt are secondarily transferred in a lump onto the recording paper S.

The intermediate transferring belt Bt subjected to the secondary transfer is cleaned away by means of a belt cleaner CLB according to an example of a cleaning device for an intermediate transferring member which is provided below the intermediate transferring belt Bt at a right side. A residue such as a developer or paper powder which is not transferred but left on the intermediate transferring belt Bt in the secondary transfer is removed from the intermediate transferring belt Bt by means of the belt cleaner CLB. In FIG. 2, the residue removed from the intermediate transferring belt Bt flows into a belt residue delivering path CLB 1 provided on a lower part in the belt cleaner CLB and extended rearward, and is delivered to a back side of the image forming apparatus body U3 by means of a belt cleaner residue delivering member CLB2 disposed in the belt residual delivering path CLB 1. The secondary transferring roll T2*b* and the belt cleaner CLB are disposed to enable a free separation/contact from/with the intermediate transferring belt Bt.

The recording paper S having a toner image transferred secondarily thereto is delivered to a fixing device F via a posttransferring guide SG2 according to an example of a guiding member and a medium delivering belt BH according to an example of a delivering member. The fixing device F has a heating roll Fh according to an example of a heating and fixing member and a pressurizing roll Fp according to an example of a pressurizing and fixing member, and the recording paper S is delivered to a fixing region Q5 to be a region in which the heating roll Fh and the pressurizing roll Fp come in pressure contact with each other. The toner image on the recording paper S is heated and fixed by the fixing device F when passing through the fixing region Q5. A switching gate GT1 according to an example of a switching member is provided on a downstream side of the fixing device F. The switching gate GT1 selectively switches the recording paper S delivered along the paper delivering path SH2 and heated and fixed in the fixing region Q5 into the paper discharging path SH3 side or the paper inverting path SH4 side in the paper processing device U4 depending on setting.

The paper S delivered to the paper discharging path SH3 is delivered to a paper delivering path SH5 of the paper processing device U4, and a warpage, that is, a so-called curl of the paper S is corrected by means of a curl correcting member U4*a* according to an example of a warpage correcting member which is disposed in the paper delivering path SH5 and the paper S is then discharged from a discharging roll Rh according to an example of a medium discharging member to a discharging tray TH1 according to an example of a medium discharging portion of the paper processing device U4 with an image recording surface of the paper turned upward, that is, faceup.

The paper S delivered to the paper inverting path SH4 side of the image forming apparatus body U3 through the switching gate GT1 is delivered to the paper inverting path SH4 of the image forming apparatus body U3 via a Mylar gate GT2 according to an example of a flexible switching member.

At this time, if the recording paper S is discharged with the image fixing surface turned downward, the recording paper S is inverted immediately after a rear end of the recording paper S passes through the Mylar gate GT2. In this case, the Mylar gate GT2 causes the recording paper S delivered to the paper inverting path SH4 to once pass therethrough exactly. When the passing recording paper S is inverted, it is delivered to the paper delivering path SH3 and SH5 sides. Then, the recording paper S is discharged to the discharging tray TH1 with the image fixing surface turned downward, that is, facedown.

The paper circulating path SH6 is connected to the middle of the paper inverting path SH4 of the image forming apparatus body U3, and a Mylar gate GT3 is disposed in the connecting portion. A downstream end of the paper inverting path SH4 of the image forming apparatus body U3 is connected to a paper inverting path SH7 of the paper processing device U4.

The recording paper S delivered to the paper inverting path SH4 via the switching gate GT1 is delivered to the paper inverting path SH7 side of the paper processing device U4 through the Mylar gate GT3. The Mylar gate GT3 causes the recording paper S delivered along the paper inverting path SH4 to once pass therethrough exactly, and delivers the passing recording paper S to the paper circulating path SH6 side when it is inverted.

The recording paper S delivered to the paper circulating path SH6 is retransmitted to the transferring region Q4 via the paper feeding path SH1, and is subjected to duplex printing and is then delivered to the paper processing device U4, and is thereafter discharged to the discharging tray TH1.

The paper delivering path SH is constituted by elements indicated as the designations of SH1 to SH7. Moreover, a paper delivering device SU is constituted by elements indicated as the designations of SH, Ra, Rr, Rh, SGr, SG1, SG2, BH and GT1 to GT3.

(Waste Developer Delivering Device)

Figure 3:
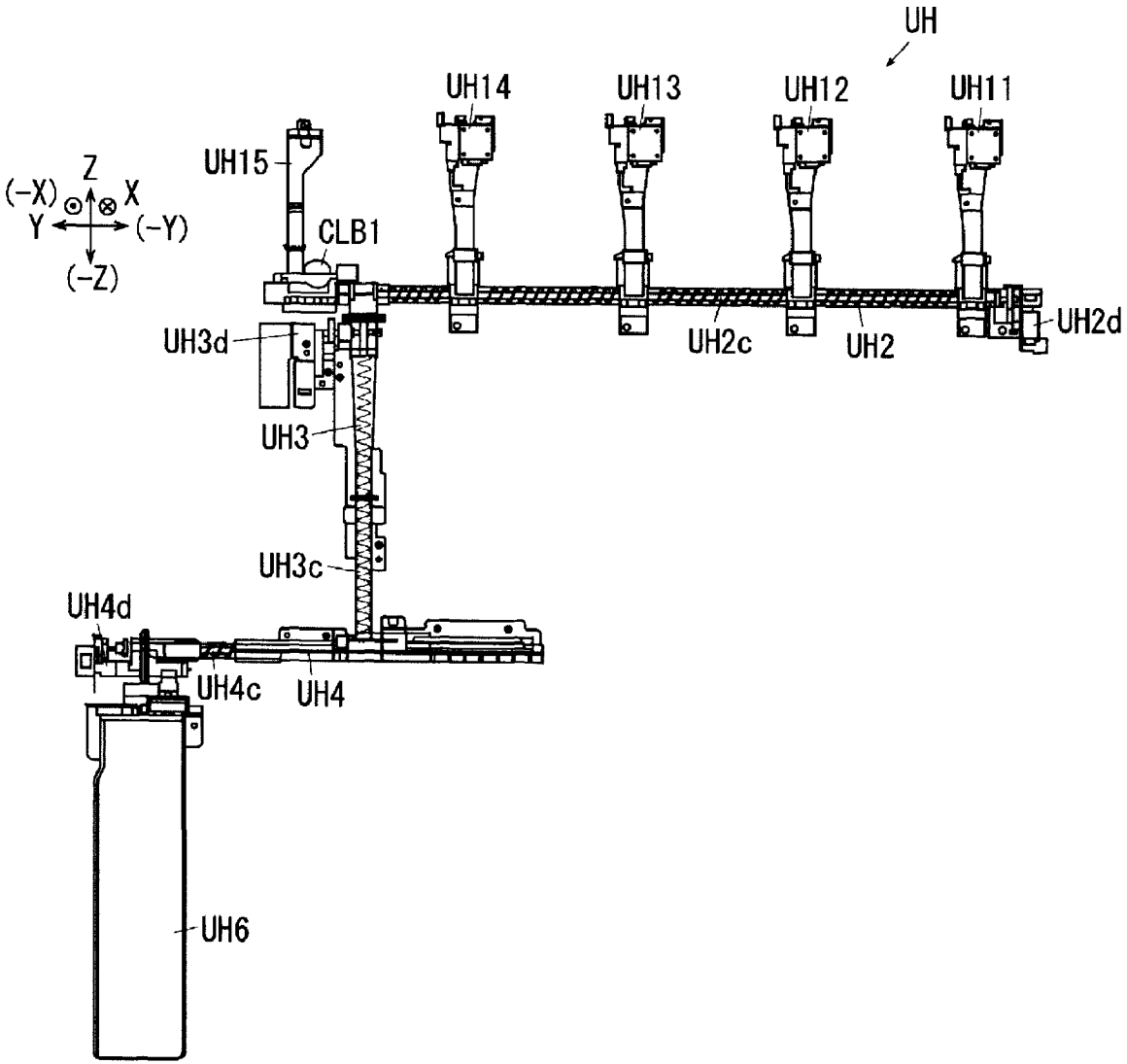
FIG. 3 is a sectional view showing a main part of a whole developer delivering device.

FIG. 3 is a sectional view showing a main part of the whole developer delivering device.

A waste developer delivering device UH according to an example of the developer delivering device is supported on a rear part of the image forming apparatus body U3.

The waste developer delivering device UH has five developer dropping units UH11, UH12, UH13, UH14 and UH15 extended in a vertical direction. A residue delivering path CLk1 extended from the cleaner CLk is connected to the first developer dropping unit UH11 disposed on a leftmost side, that is, a most −Y side and a rightmost side shown in FIG. 3. A residue delivering path CLc1 extended from the C-color cleaner CLc and the deteriorated developer delivering path G2*k* extended from the K-color developing device Gk are connected to the second developer dropping unit UH12 disposed on a right side of the first developer dropping unit UH11.

A residue delivering path CLm1 extended from the M-color cleaner CLm and the deteriorated developer delivering path G2*c* extended from the C-color developing device Gc are connected to the third developer dropping unit UH13 disposed on a right side of the second developer dropping unit UH12. A residue delivering path CLy1 extended from the Y-color cleaner CLy and the deteriorated developer delivering path G2*m* extended from the M-color developing device Gm are connected to the fourth developer dropping unit UH14 disposed on a right side of the third developer dropping unit UH13. The deteriorated developer delivering path G2*y* extended from the Y-color developing device Gy is connected to the fifth developer dropping unit UH15 disposed on a right side of the fourth developer dropping unit UH14. Furthermore, the belt residue delivering path CLB1 extended from the belt cleaner CLB is connected to a left side of the fifth developer dropping unit UH15. The details of the belt residue delivering path CLB1 will be described below.

Lower ends of the developer dropping units UH11 to UH15 are connected to each other through a meeting and delivering path UH2 extended in a horizontal direction. The meeting and delivering path UH2 according to the first exemplary embodiment is connected to penetrate through the lower ends of the developer dropping units UH11 to UH15 in a transverse direction, and a meeting and delivering auger UH2*c* according to an example of a delivering member extended in the transverse direction is accommodated in the meeting and delivering path UH2. A driving operation is transmitted from a meeting and delivering motor UH2*d* according to an example of a driving source to a left end of the meeting and delivering auger UH2*c*. Referring to a waste developer in the meeting and delivering path UH2, a developer dropped from the first to fourth developer dropping units UH11 to UH14 is delivered from left to right and a developer transmitted from the fifth developer dropping unit UH15 and the belt residue delivering path CLB1 is delivered from right to left.

An upper end of a dropping and delivering path UH3 according to an example of a delivering path extended in the vertical direction is connected to a right part of the meeting and delivering path UH2, and the waste developer delivered to a meeting place of the meeting and delivering path UH2 flows into the dropping and delivering path UH3 and is thus dropped and delivered. A crosslinkage preventing member UH3*c* is accommodated in the dropping and delivering path UH3 according to the first exemplary embodiment. The crosslinkage preventing member UH3*c* is extended in the vertical direction and is reciprocated in the vertical direction to break the waste developer stuck to an internal wall surface of the dropping and delivering path UH3. The crosslinkage preventing member UH3*c* according to the first exemplary embodiment is constituted by a so-called coil spring which is formed by winding a wire helically. A crosslinkage preventing motor unit UH3*d* for reciprocating the crosslinkage preventing member UH3*c* in the vertical direction is supported on an upper and right side of the dropping and delivering path UH3. Since the crosslinkage preventing member UH3*c* and the crosslinkage preventing motor unit UH3*d* are well-known as described in JP-A-2005-091848 Publication, for example, detailed description will be omitted.

A container delivering path UH4 extended in the transverse direction is connected to a lower end of the dropping and delivering path UH3, and the waste developer dropped through the dropping and delivering path UH3 flows therein. A container delivering auger UH4*c* extended in the transverse direction is accommodated in the container delivering path UH4. A transverse direction delivering motor UH4*d* is supported on a right end of the container delivering path UH4. A driving operation is transmitted from the transverse direction delivering motor UH4*d* to the container delivering auger UH4*c*, and the waste developer in the container delivering path UH4 is delivered from left to right.

A developer collecting container UH6 extended in the vertical direction is connected to a right end of the container delivering path UH4, and the developer delivered through the container delivering path UH4 flows therein and is thus collected.

(Explanation of Connecting Portion of Belt Residue Delivering Path and Meeting and Delivering Path)

Figure 4:
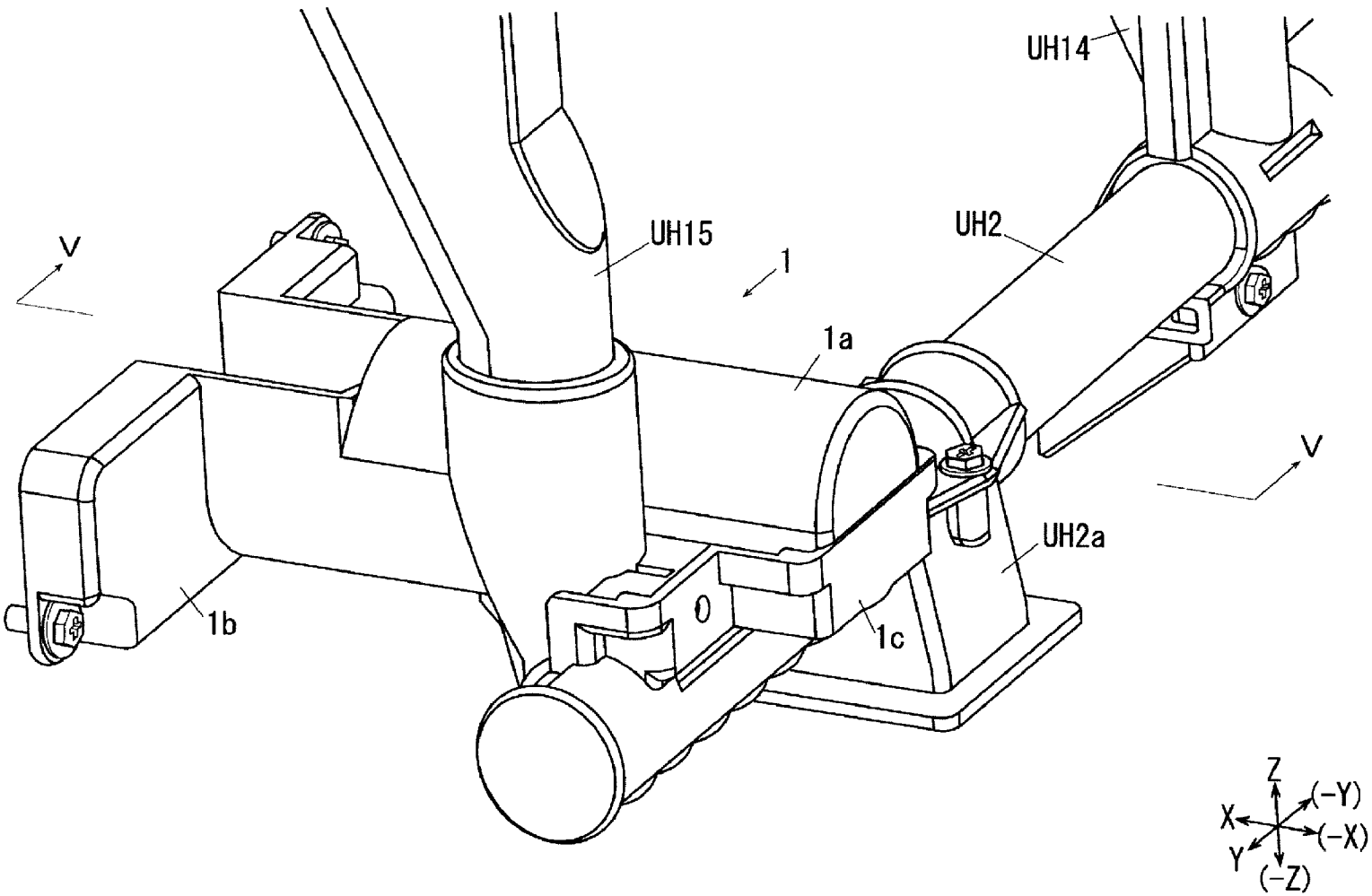
FIG. 4 is a perspective view showing a connecting portion of a belt residue delivering path and a meeting and delivering path according to the first exemplary embodiment.

FIG. 4 is a perspective view showing the connecting portion of the belt residue delivering path and the meeting and delivering path according to the first exemplary embodiment.

Figure 5:
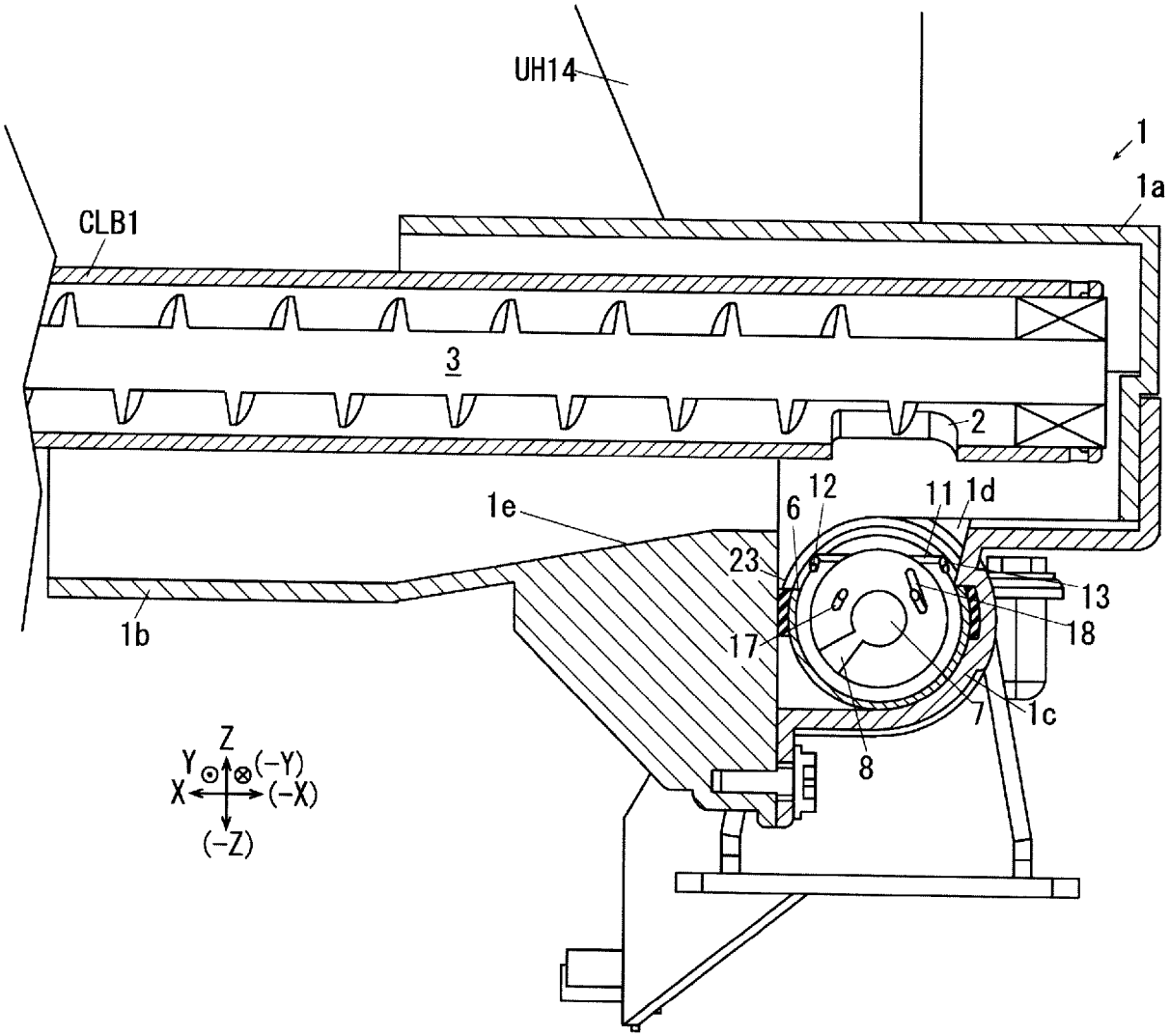
FIG. 5 is a sectional view taken along a V-V line in FIG. 4.

FIG. 5 is a sectional view taken along a V-V line in FIG. 4.

In FIG. 4, a connecting member UH2*a* to the dropping and delivering path UH3 is supported on a left side of the fifth developer dropping unit UH15 at a right end of the meeting and delivering path UH2, and a delivering path connecting member 1 according to an example of the connecting portion is supported between the connecting member UH2*a* and the fifth developer dropping unit UH15. In FIG. 4, the delivering path connecting member 1 has a cylindrical portion 1*a* in a rear part, and a fixed portion 1*b* formed integrally with a front end of the cylindrical portion 1*a* and fixed and supported on a frame member of the image forming apparatus body U3 which is not shown.

In FIGS. 4 and 5, a cylindrical meeting and coupling portion 1*c* extended in an orthogonal direction to an axial direction of the cylindrical portion 1*a* is formed in a lower part of the cylindrical portion 1*a*, and the meeting and delivering path UH2 according to an example of a second delivering path is attached to the meeting and coupling portion 1*c* in an inserting state. A connecting port 1*d* penetrating in the vertical direction is formed between the meeting and coupling portion 1*c* and the cylindrical portion 1*a*.

In FIG. 5, the cylindrical portion 1*a* is provided with a diameter reducing portion 1*e* having an inside diameter reduced gradually from the front end toward the connecting port 1*d*.

In FIGS. 4 and 5, the belt residue delivering path CLB1 according to an example of a first delivering path extended from the belt cleaner CLB is inserted into the cylindrical portion 1*a*. An outlet 2 opened downward is formed on a rear end of the belt residue delivering path CLB1. A residue delivering auger 3 according to an example of a first delivering member is rotatably supported in the belt residue delivering path CLB1, and the developer in the belt residue delivering path CLB1 is delivered toward the outlet 2.

As shown in FIG. 5, in a state in which the belt residue delivering path CLB1 is attached to the cylindrical portion 1*a*, the outlet 2 is disposed above the connecting port 1*d* and the developer flowing out of the outlet 2 is dropped toward the connecting port 1*d* and is thus delivered. When the belt residue delivering path CLB1 is to be inserted into the cylindrical portion 1*a*, it is guided by the diameter reducing portion 1*e* and is thus inserted easily, and furthermore, a distance between the connecting port 1*d* and the outlet 2, that is, a clearance is reduced. Accordingly, there is narrowed the clearance through which the developer dropped from the outlet 2 is turned around and thus leaks out. Thus, the leakage of the developer is reduced.

Figure 6:
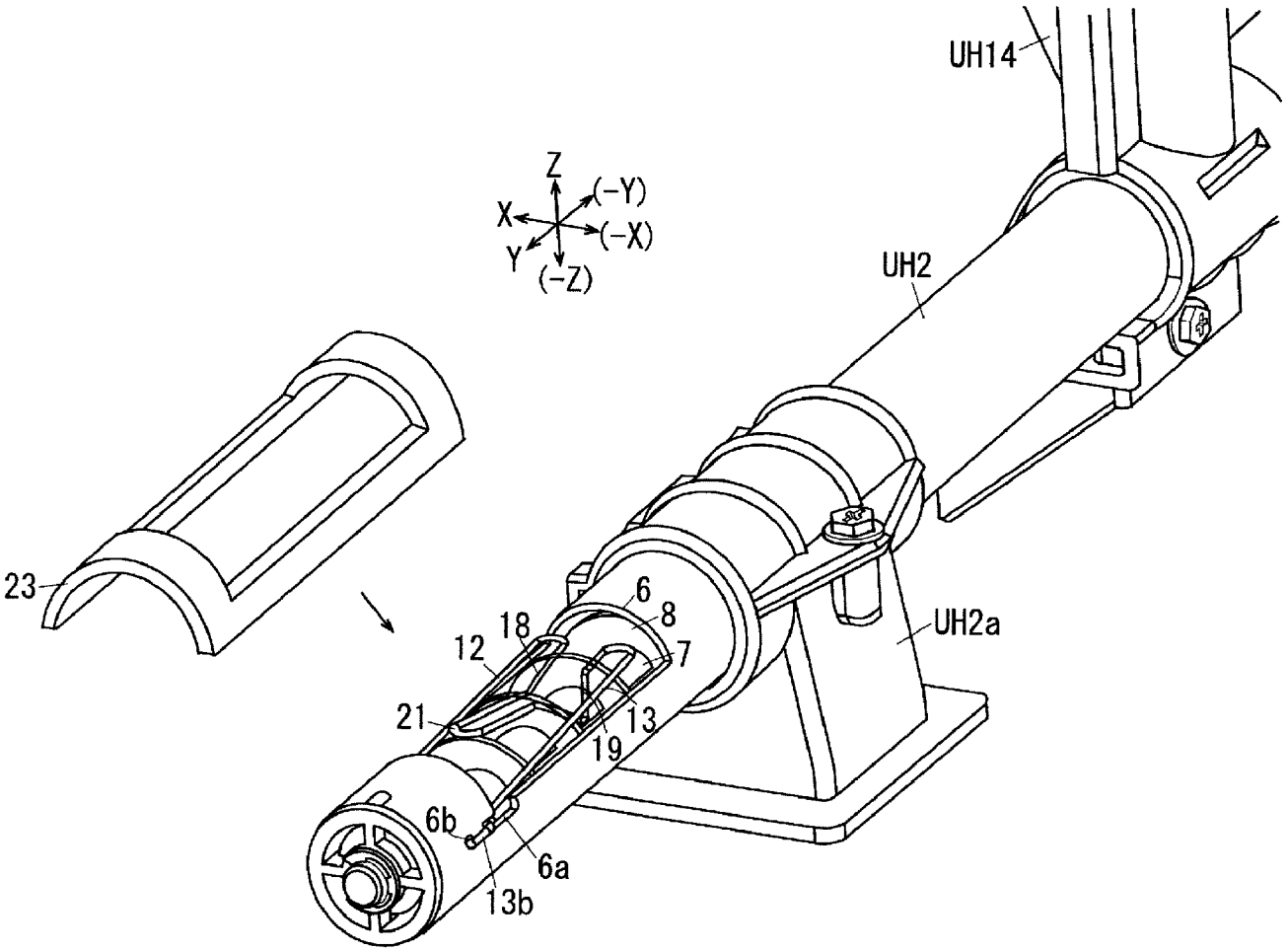
FIG. 6 is an explanatory view showing a state in which the belt residue delivering path is removed in FIG. 4.

FIG. 6 is an explanatory view showing a state in which the belt residue delivering path is removed in FIG. 4.

Figure 7:
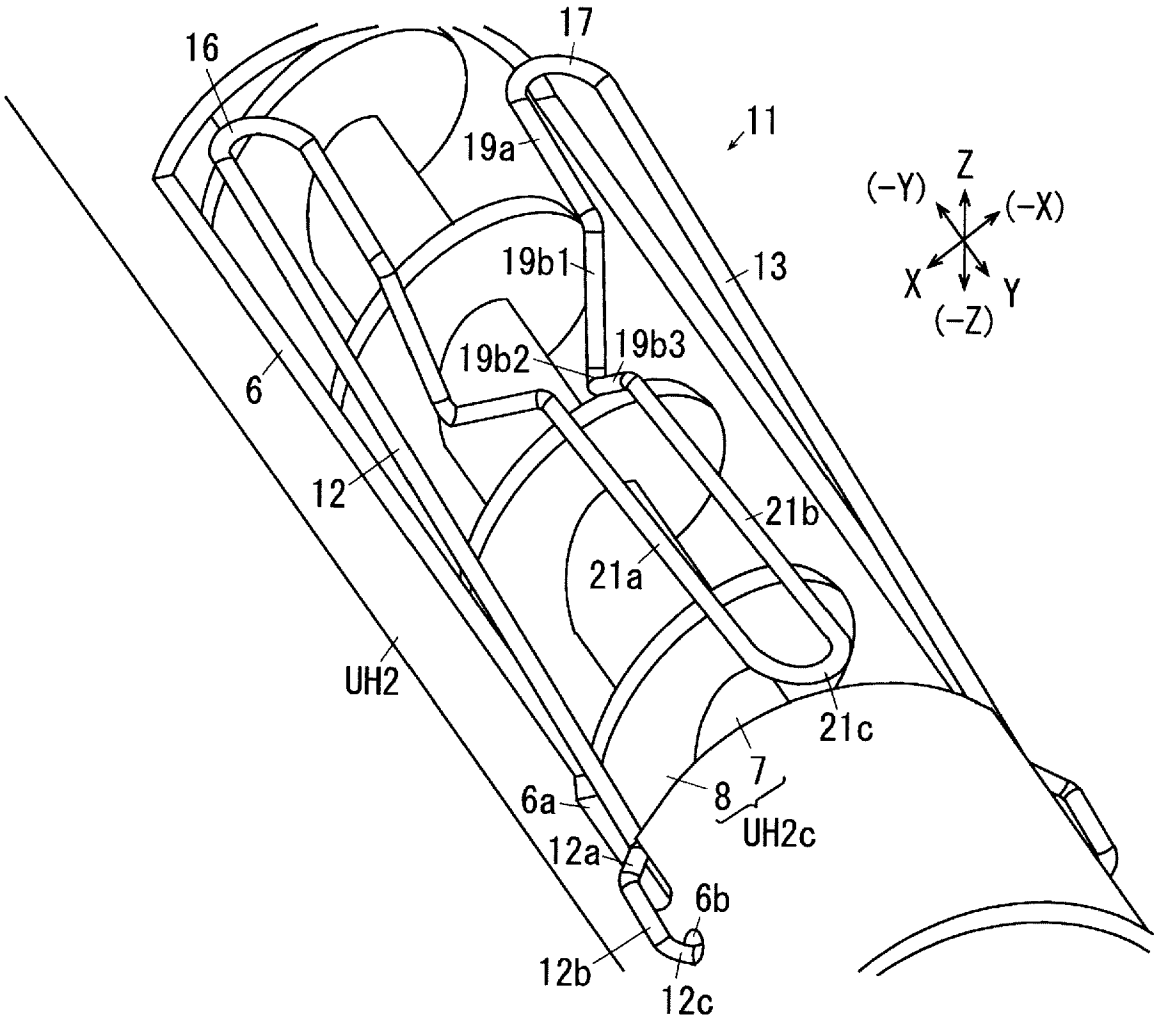
FIG. 7 is a perspective view showing a breaking member portion attached to the meeting and delivering path.

FIG. 7 is a perspective view showing a breaking member portion attached to the meeting and delivering path.

In FIGS. 5 and 6, an inlet 6 according to an example of an opening extended in the transverse direction is formed on an upper surface at a right end of the meeting and delivering path UH2. In FIG. 5, the inlet 6 according to the first exemplary embodiment is disposed below the connecting port 1*d*, and the developer flowing out of the belt residue delivering path CLB1 and passing through the connecting port 1*d* flows into the meeting and delivering path UH2 through the inlet 6. The inlet 6 according to the first exemplary embodiment has a structure in which the developer delivered from the fifth developer dropping unit UH15 can also flow therein in addition to the developer delivered through the belt residue delivering path CLB1.

In FIGS. 6 and 7, a pair of member introducing portions 6*a* is longitudinally formed like a cut at a right end of the inlet 6, and an attaching hole 6*b* according to an example of the attaching portion is formed rightward from the member introducing portion 6*a*.

In FIGS. 5 to 7, the meeting and delivering auger UH2*c* according to an example of a second delivering member which is extended in the transverse direction is rotatably supported in the meeting and delivering path UH2. The meeting and delivering auger UH2*c* has a rotating shaft 7 extended in the transverse direction and a helical delivering blade 8 supported on an outer periphery of the rotating shaft 7. The delivering blade 8 is constituted by a helix in a winding direction in which the developer is delivered from a right side to be an upstream side toward a left side to be a downstream side in a region from the inlet 6 to an upper end of the dropping and delivering path UH3. Accordingly, the developer flowing in through the inlet 6 is delivered toward the dropping and delivering path UH3 by means of the meeting and delivering auger UH2*c*.

Figure 8:
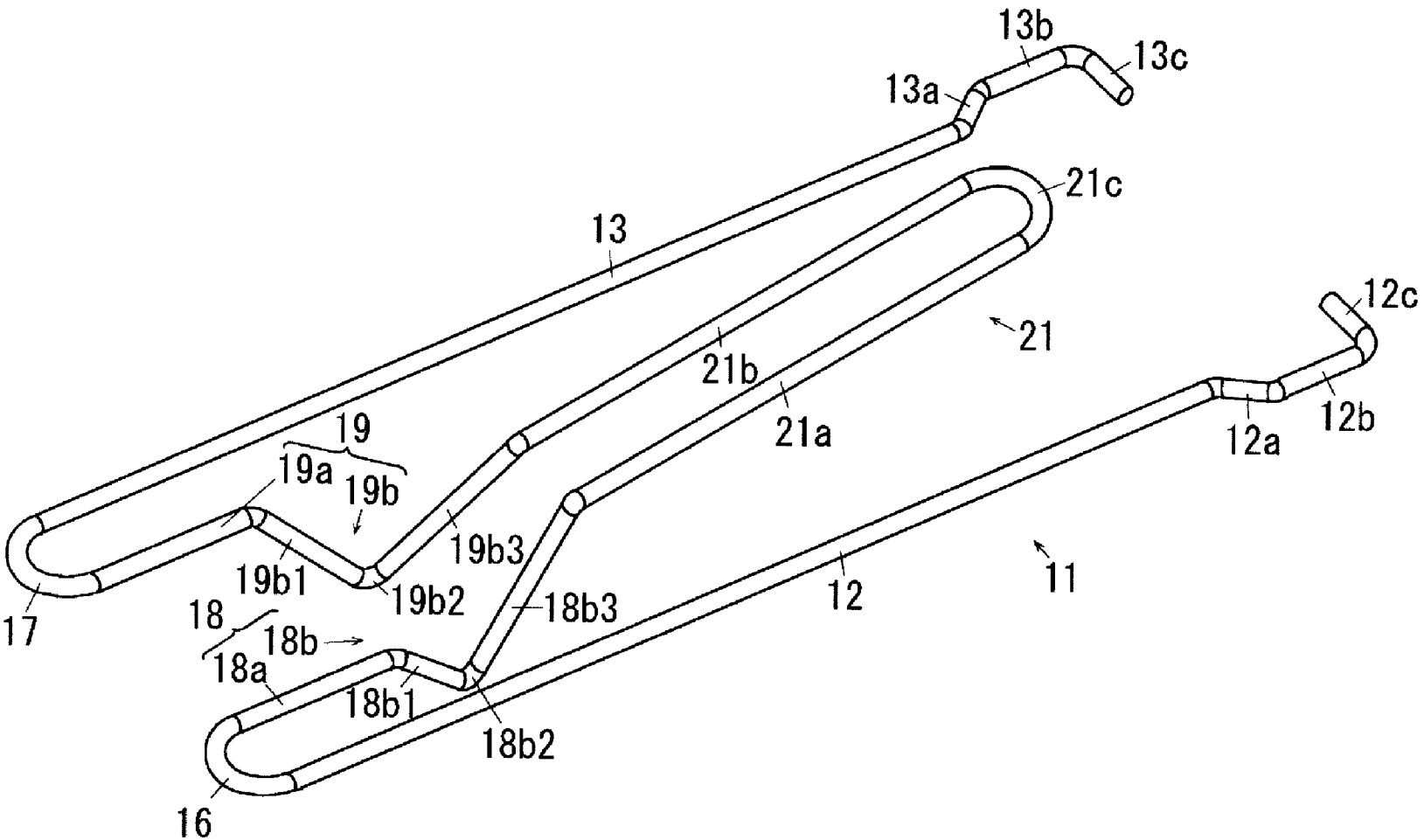
FIG. 8 is a perspective view showing the breaking member according to the first exemplary embodiment of the invention.

FIG. 8 is a perspective view showing the breaking member according to the first exemplary embodiment of the invention.

Figure 9A:
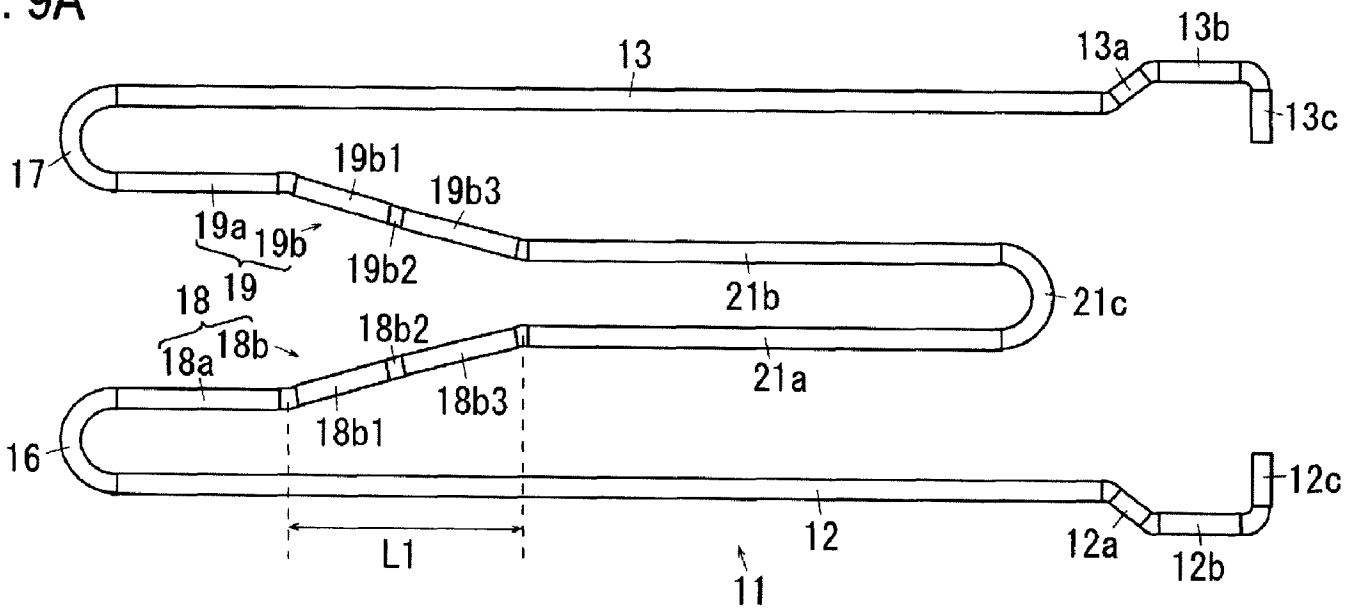
FIG. 9A is a plan view showing the breaking member.
Figure 9B:
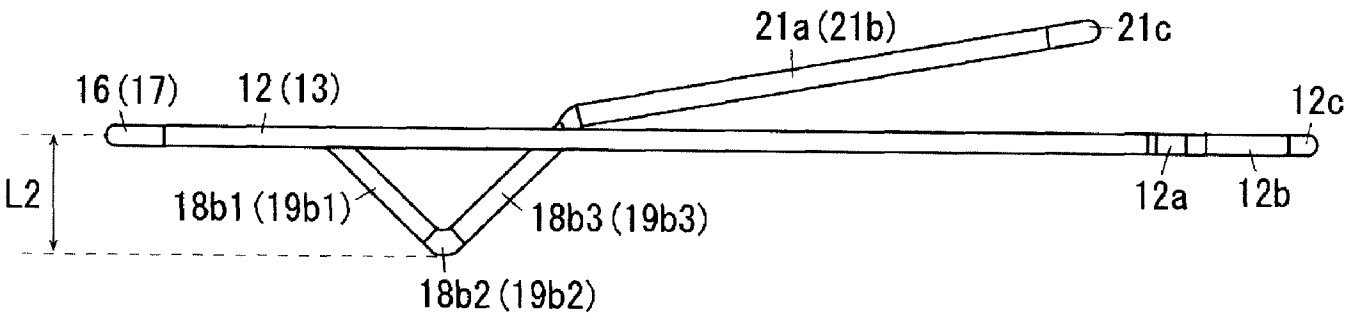
FIG. 9B is a side view showing the breaking member.

FIG. 9A is a plan view showing the breaking member, and FIG. 9B is a side view showing the breaking member.

In FIGS. 5 to 7, a developer breaking member 11 is supported on the inlet 6. In FIGS. 5 to 9B, the breaking member 11 is extended in a developer delivering direction of the meeting and delivering path UH2 and has a front breaking portion 12 and a rear breaking portion 13 which make a pair and are disposed opposite to side walls of the meeting and delivering path UH2. In other words, the breaking member 11 according to the first exemplary embodiment has a breaking portion (12+13) constituted by the front breaking portion 12 according to an example of a first breaking portion and the rear breaking portion 13 according to an example of a second breaking portion. The breaking portion (12+13) indicates a member disposed along the wall of the delivering path and serving to break the developer stuck to the wall of the delivery path interlockingly with a rotation of the delivering member provided in the delivering path.

Right ends of the breaking portions 12 and 13 are provided with leading portions 12*a* and 13*a* extended with an outward tilt corresponding to the member introducing portion 6*a*, and right ends of the leading portions 12*a* and 13*a* are provided with outer swollen portions 12*b* and 13*b* extended along an outside surface of the meeting and delivering path UH2. Right ends of the outer swollen portions 12*b* and 13*b* are provided with supported portions 12*c* and 13*c* extended inward in a longitudinal direction and supported in a fitting state into the attaching port 6*b*.

A U-shaped front connecting portion 16 curved rearward according to an example of a first connecting portion is formed integrally with a left end of the front breaking portion 12 at a downstream side in the developer delivering direction of the meeting and delivering auger UH2*c*, and a U-shaped rear connecting portion 17 curved forward according to an example of a second connecting portion is formed integrally with a left end of the rear breaking portion 13. A connecting portion (16+17) according to the first exemplary embodiment is constituted by the front connecting portion 16 and the rear connecting portion 17.

A front contact portion 18 extended rightward according to an example of a first contact portion is formed integrally with a right end of the front connecting portion 16, and a rear contact portion 19 extended rightward according to an example of a second contact portion is formed integrally with a right end of the rear connecting portion 17. More specifically, the contact portions 18 and 19 are disposed between the breaking portions 12 and 13 and a center of the rotating shaft 7.

The front contact portion 18 and the rear contact portion 19 have left ends 18*a* and 19*a* extended rightward from the right ends of the connecting portions 16 and 17. Lower bent portions 18*b* and 19*b* extended rightward according to an example of a contact portion body are formed integrally with right ends of the left ends 18*a* and 19*a*. In FIG. 9A, the lower bent portions 18*b* and 19*b* have downward moving contact portions 18*b*1 and 19*b*1 which are tilted inward in a longitudinal direction, that is, in such a direction as to approach the center of the rotation of the rotating shaft 7 to gradually reduce a mutual interval in the longitudinal direction from the right ends of the left ends 18*a* and 19*a* rightward and are tilted downward, that is, in such a direction as to approach the rotating shaft 7 according to an example of a separating tilt portion and a downstream side contact portion. Moreover, upward moving contact portions 18*b*3 and 19*b*3 according to an example of an approaching tilt portion and an upstream side contact portion are formed integrally with lower ends 18*b*2 and 19*b*2 of the downward moving contact portions 18*b*1 and 19*b*1. The upward moving contact portions 18*b*3 and 19*b*3 are tilted inward in the longitudinal direction and upward to gradually reduce a mutual interval in the longitudinal direction rightward.

A contact portion (18+19) according to the first exemplary embodiment is constituted by the front contact portion 18 and the rear contact portion 19.

A right coupling portion 21 according to an example of a coupling portion is supported integrally with right ends of the upward moving contact portions 18*b*3 and 19*b*3. The right coupling portion 21 has a pair of front and rear tilt portions 21*a* and 21*b* tilted in an upward direction, that is, in such a direction as to separate from the rotating shaft 7 rightward from the right ends of the upward moving contact portions 18*b*3 and 19*b*3, and a right end 21*c* for coupling right ends of the tilt portions 21*a* and 21*b*.

As shown in FIGS. 6 to 9B, the breaking member 11 according to the first exemplary embodiment is formed by bending a wire and is constituted to be an elastic member which is elastically deformable. For the wire, it is possible to use a metal such as stainless, for example. Accordingly, the breaking member 11 is supported to enable a vibration with the supported portions 12*c* and 13*c* set to be fixed ends. Although the breaking member 11 according to the first exemplary embodiment has the elastically deformable structure, the invention is not restricted to the structure but it is also possible to have a structure which is not elastically deformable and to enable the vibration through a function of a gravity and a contact with the delivering blade 8 by setting the supported portions 12*c* and 13*c* as the center of the rotation.

In FIGS. 7 and 9A, in the breaking member 11 according to the first exemplary embodiment, a length L1 in the transverse direction of a region in which the lower bent portions 18*b* and 19*b* are protruded toward the delivering blade 8 side from the breaking portions 12 and 13 is set to be equal to or smaller than a distance advanced in the developer delivering direction in one rotation of the delivering blade 8, that is, a so-called helical pitch.

In FIG. 9B, in the breaking member 11 according to the first exemplary embodiment, an interval L2 between left ends to be downstream ends in the developer delivering direction of the breaking portions 12 and 13 and the lower ends 18*b*2 and 19*b*2 to be the ends at the delivering blade 8 side of the lower bent portions 18*b* and 19*b* is set to be smaller than a radius of the rotation of the delivering blade 8 of the meeting and delivering auger UH2*c*.

In FIGS. 5 and 6, a seal 23 according to an example of a leakage preventing member is supported on the outlet 6 of the meeting and delivering path UH2 along an edge of the outlet 6. The seal 23 according to the first exemplary embodiment is suck to the meeting and delivering path UH2 in a state in which the breaking member 11 is supported. The seal 23 is stuck in a state in which the member introducing portion 6*a* and the attaching hole 6*b* are closed.

As shown in FIG. 5, accordingly, a clearance between the meeting and delivering path UH2 and the meeting and coupling portion 1*c* is hermetically closed in a state in which the seal 23 is compressed, and furthermore, the member introducing portion 6*a* and the attaching hole 6*b* are closed so that the developer is prevented from leaking out.

Function of First Exemplary Embodiment

In the copying machine U according to the first exemplary embodiment which has the structure, the developer discharged from each of the developing devices Gy to Gk or the developer or the corona product collected by each of the cleaners CLy, CLm, CLc, CLk and CLB in a formation of an image is delivered and collected into the waste toner collecting device UH4 via the developer dropping units UH11 to UH15, the meeting and delivering path UH2 and the dropping and delivering path UH3.

At this time, the developer collected by the belt cleaner CLB is subjected to stirring in the developing devices Gy to Gk, the development in the developing region, the primary transfer in the primary transferring rolls T1*y* to T1*k* and the secondary transfer in the secondary transferring device T2, and is thus deteriorated, and a flowability of the developer is particularly reduced.

In some cases in which the developer collected by the belt cleaner CLB is dropped from the inlet 2 and flows into the inlet 6 through the connecting port 1*d*, the developer is stuck to an inner part of the inlet 6 or in the vicinity of the connecting port 1*d*, and thus coheres and grows like a lump. There is a fear that the developer growing like the lump might grow to cover the connecting port 1*d* and the connecting port 1*d* might be finally closed, resulting in clogging of the developer in the case in which the breaking member 11 is not disposed. In the first exemplary embodiment, correspondingly, the breaking member 11 is disposed from the inlet 6 to the connecting port 1*d*.

In the breaking member 11 according to the first exemplary embodiment, the front contact portion 18 and the rear contact portion 19 are connected to the front breaking portion 12 and the rear breaking portion 13 respectively, and the contact portions 18 and 19 come in contact with the meeting and delivering auger UH2*c*. With the rotation of the meeting and delivering auger UH2*c*, accordingly, the respective contact portions 18 and 19 are pressed against the helical delivering blade 8 and are thus tilted upward or deformed elastically, and are then restored elastically when getting over the delivering blade 8, or are tilted downward by a gravity. The operation is repeated to carry out a vibration.

At this time, in the breaking member 11 according to the first exemplary embodiment, the front contact portion 18 and the rear contact portion 19 longitudinally separate from each other with the rotating shaft 7 interposed therebetween. Therefore, timings for causing the front contact portion 18 and the rear contact portion 19 to come in contact with the helical delivering blade 8 are different from each other. Accordingly, the front contact portion 18 and the rear contact portion 19 are vibrated independently in different timings.

When each of the contact portions 18 and 19 comes in contact with the helical delivering blade 8, moreover, it is pressed in the longitudinal direction in addition to the vertical direction along the surface of the helical delivering blade 8. In the breaking member 11 according to the first exemplary embodiment, therefore, each of the contact portions 18 and 19 does not generate a simply vertical vibration in a one-dimensional direction as in the related art but a two-dimensional vibration having components in the vertical and longitudinal directions. Accordingly, the front contact portion 18 and the rear contact portion 19 independently carry out the two-dimensional vibration respectively, and the front breaking portion 12 and the rear breaking portion 13 also carry out the two-dimensional vibration to break the developer stuck to the inner part of the inlet 6 or the connecting port 1*d*. In the breaking member 11 according to the first exemplary embodiment, therefore, it is also possible to break the lump of the developer which cannot be fully broken in the related art in which the one-dimensional vibration is carried out. Thus, a capability for breaking the developer can be enhanced.

In the breaking member 11 according to the first exemplary embodiment, particularly, the coupling portion 21 is coupled to the contact portions 18 and 19 through the right end 21*c* which is provided further rightward from the tilt portions 21*a* and 21*b* extended in the rightward direction. When the contact portions 18 and 19 carry out the vibration, therefore, one of the vibrations influences the other vibration with difficulty. When the contact portions 18 and 19 are extended in the longitudinal direction, moreover, they are easily opened longitudinally by the elastic deformation of the tilt portions 21*a* and 21*b* which are long in the transverse direction. Consequently, the two-dimensional vibration in which the breaking portions 12 and 13 are independent is inhibited with difficulty so that the capability for breaking the developer can be enhanced.

Figure 10A:
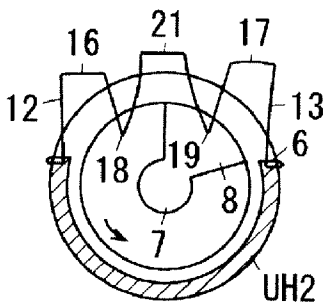
FIG. 10A is an explanatory view showing a simulation result of a vibration of the breaking member and showing a section of a main part.
Figure 10B:
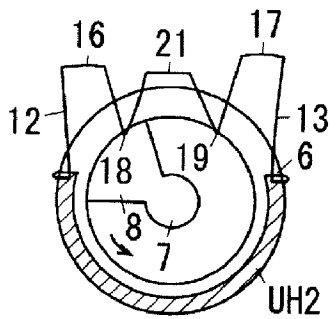
FIG. 10B is an explanatory view showing a state in which a delivering member is rotated by 90 degrees in the state of FIG. 10A.
Figure 10C:
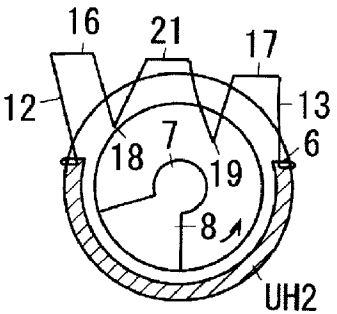
FIG. 10C is an explanatory view showing a state in which the delivering member is rotated by 90 degrees in the state of FIG. 10B.
Figure 10D:
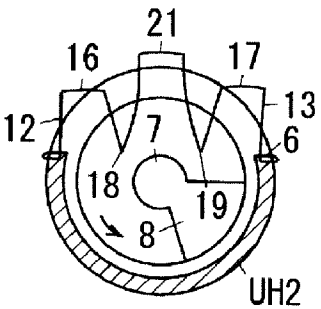
FIG. 10D is an explanatory view showing a state in which the delivering member is rotated by 90 degrees in the state of FIG. 10C.

FIGS. 10A to 10D are explanatory views showing a simulation result of the vibration of the breaking member, and FIG. 10A is a sectional view showing a main part, FIG. 10B is an explanatory view showing a state in which the delivering member is rotated by 90 degrees in the state of FIG. 10A, FIG. 10C is an explanatory view showing a state in which the delivering member is rotated by 90 degrees in the state of FIG. 10B, and FIG. 10D is an explanatory view showing a state in which the delivering member is rotated by 90 degrees in the state of FIG. 10C.

Referring to the independent two-dimensional vibration of the breaking member 11 according to the first exemplary embodiment, a simulation was carried out by means of a computer. FIGS. 10A to 10D show results of the simulation. As a result of the simulation, as shown in FIGS. 10A, 10B, 10C and 10D, it was confirmed that the vibrations of the front breaking portion 12 and the front contact portion 18 and those of the rear breaking portion 13 and the rear contact portion 19 are independent of each other and carry out the two-dimensional vibration. As shown in FIG. 7, the breaking member 11 is tilted upward with respect to the direction of the shaft 7 in a contact with the delivering blade 8. In FIGS. 10A to 10D, there is shown a vibration including a component in the longitudinal direction in the tilting state.

In the breaking member 11 according to the first exemplary embodiment, moreover, the length L1 is set to be smaller than the pitch of the delivering blade 8. In the case in which each of the contact portions 18 and 19 comes in contact with the delivering blade 8, the delivering blade 8 first comes in contact with the upward moving contact portions 18*b*3 and 19*b*3 at the upstream side and is then tilted upward or deformed elastically, and is tilted downward or restored elastically when the lower ends 18*b*2 and 19*b*2 get over the delivering blade 8. Consequently, the downward moving contact portions 18*b*1 and 19*b*1 come in contact with the delivering blade 8. At this time, the length L1 is smaller than the pitch, and the delivering blade 8 on the upstream side comes in contact with the upward moving contact portions 18*b*3 and 19*b*3 before the downward moving contact portions 18*b*1 and 19*b*1 separate from the delivering blade 8. If the length L1 is greater than the pitch, the upward moving contact portions 18*b*3 and 19*b*3 come in contact with the next delivering blade 8 after a period in which the downward moving contact portions 18*b*1 and 19*b*1 separate from the delivering blade 8 and the lower bent portions 18*b* and 19*b* do not come in contact with the delivering blade 8, and the breaking member 11 is not vibrated. Thus, there is generated a period in which the breaking member 11 is not vibrated. On the other hand, in the first exemplary embodiment, the length L1 is smaller than the pitch of the delivering blade 8 and any place in the lower bent portions 18*b* and 19*b* continuously comes in contact with the delivering member 8 and is thus vibrated. As compared with the case in which the length L1 is greater than the pitch, consequently, it is possible to enhance the capability for breaking the developer.

In the first exemplary embodiment, furthermore, the downward moving contact portions 18*b*1 and 19*b*1 are not bent downward like a step from the height of the breaking portion but are gradually tilted in a downward direction toward the upstream side. When each of the contact portions 18 and 19 gets over the delivering blade 8, accordingly, the lower ends 18*b*2 and 19*b*2 get over the delivering blade 8 and the downward moving contact portions 18*b*1 and 19*b*1 then come in contact with the delivering blade 8. If the downward moving contact portions 18*b*1 and 19*b*1 are bent downward like the step, they get over the lower ends 18*b*2 and 19*b*2 and are then tilted downward or restored elastically in a flicking manner so that the lower ends 18*b*2 and 19*b*2 of the breaking member 11 collide with the rotating shaft 7 or the delivering blade 8, resulting in a generation of a noise. On the other hand, in the breaking member 11 according to the first exemplary embodiment, the lower ends 18*b*2 and 19*b*2 get over the delivering blade 8 and the downward moving contact portions 18*b*1 and 19*b*1 then come in contact with the delivering blade 8 so that the generation of the noise is reduced.

In the breaking member 11 according to the first exemplary embodiment, moreover, the coupling portion 21 is gradually tilted upward in a rightward direction. When the breaking member 11 is vibrated, the coupling portion 21 is prevented from coming in contact with the delivering blade 8. Accordingly, it is possible to reduce the generation of the noise due to the contact of the coupling portion 21 with the delivering blade 8.

In the breaking member 11 according to the first exemplary embodiment, furthermore, the interval L2 is set to be smaller than the radius of the rotation of the delivering blade 8, and the connecting portions 16 and 17 to be freely vibrated are disposed sufficiently above the lower ends 18*b*2 and 19*b*2. When the lower ends 18*b*2 and 19*b*2 get over the delivering blade 8, accordingly, a contact with the rotating shaft 7 or the delivering blade 8 is reduced even if the connecting portions 16 and 17 are flicked and vibrated freely. Thus, it is possible to reduce the generation of the noise.

In addition, the breaking portion 11 according to the first exemplary embodiment is formed integrally by bending a wire. As compared with a structure in which individual components are coupled to each other, the number of the components can be reduced and an assembly can easily be carried out.

Second Exemplary Embodiment

Figure 11C:
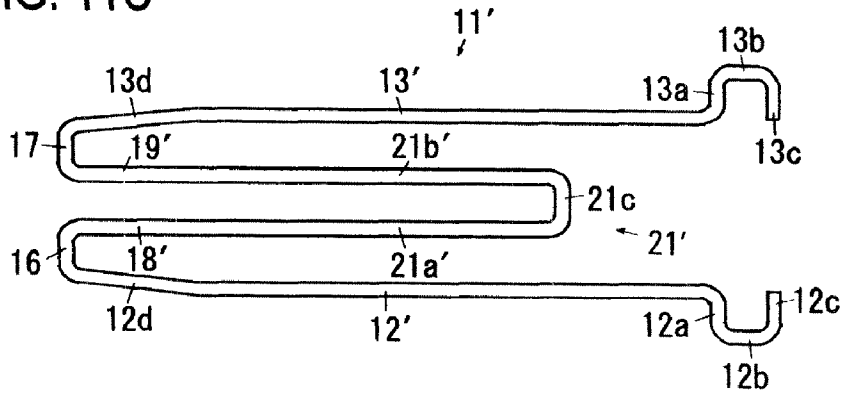
FIG. 11C is a plan view showing the breaking member according to the second exemplary embodiment.
Figure 11D:
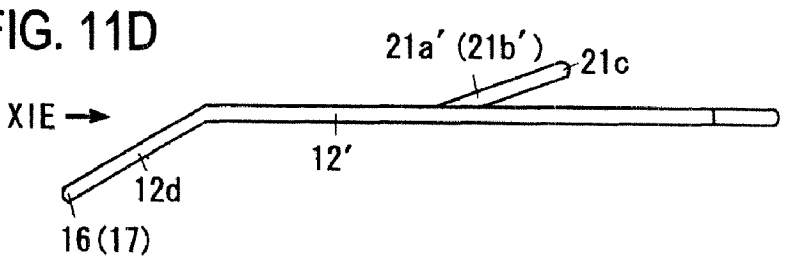
FIG. 11D is a side view showing the breaking member according to the second exemplary embodiment.
Figure 11E:
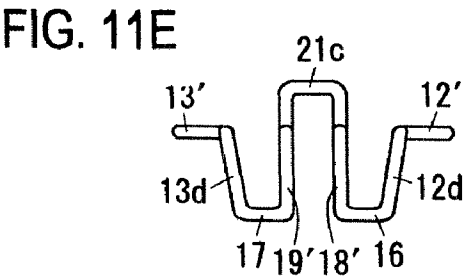
FIG. 11E is a view seen in a direction of an arrow XIE in FIG. 11D.
Figure 11A:
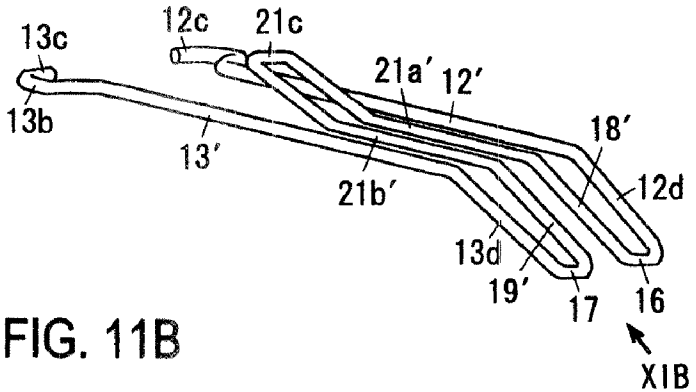
FIG. 11A is a perspective view showing a breaking member according to a second exemplary embodiment.
Figure 11B:
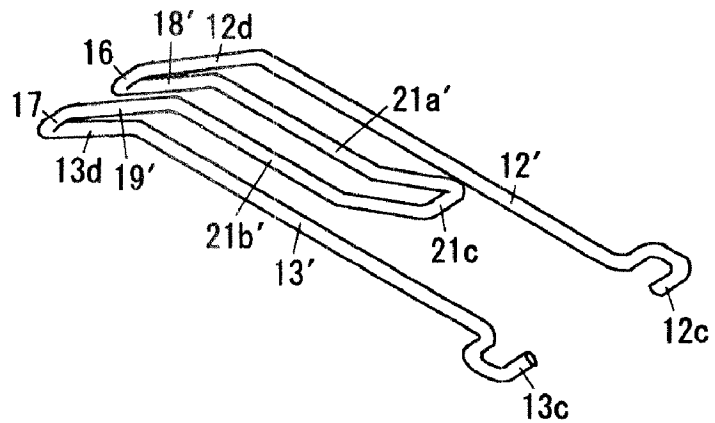
FIG. 11B is a view seen in a direction of an arrow XIB in FIG. 11A.

FIGS. 11A to 11E are explanatory views showing a breaking member according to a second exemplary embodiment, and FIG. 11A is a perspective view, FIG. 11B is a view seen in a direction of an arrow XIB in FIG. 11A, FIG. 11C is a plan view, FIG. 11D is a side view, and FIG. 11E is a view seen in a direction of an arrow XIE in FIG. 11D.

Next, the second exemplary embodiment according to the invention will be described. In the description of the second exemplary embodiment, corresponding components to the components according to the first exemplary embodiment have the same reference numerals and detailed description thereof will be omitted.

Although the second exemplary embodiment is different from the first exemplary embodiment in the following respect, the same structure as that in the first exemplary embodiment is employed in the other respects.

In FIGS. 11A to 11E, in a breaking member 11' according to the second exemplary embodiment, tilt breaking portions 12*d* and 13*d* which are gradually tilted downward in a leftward direction are formed in left parts of a front breaking portion 12' and a rear breaking portion 13' which constitute a breaking portion (12'+13'). Connecting portions 16 and 17 curved inward in a longitudinal direction are formed on left ends of the tilt breaking portions 12*d* and 13*d*, and contact portions 18' and 19' extended rightward are formed on inner ends of the connecting portions 16 and 17. The contact portions 18' and 19' according to the second exemplary embodiment are constituted by upward moving contact portions which are gradually tilted upward in a rightward direction. A contact portion (18'+19') according to the second exemplary embodiment is constituted by the front contact portion 18' and the rear contact portion 19'.

A coupling portion 21' is formed integrally with right ends of the contact portions 18' and 19', and right parts of tilt portions 21*a*' and 21*b*' are tilted obliquely and upward and right ends are coupled to each other through a right end 21*c*.

Function of Second Exemplary Embodiment

In the breaking member 11' according to the second exemplary embodiment which has the structure, the front breaking portion 12' and the front contact portion 18', and the rear breaking portion 13' and the rear contact portion 19' come in contact with a helical delivering blade 8 in different timings in the same manner as in the first exemplary embodiment. Accordingly, the breaking portions 12' and 13' independently carry out a two-dimensional vibration respectively so that a developer is broken in the same manner as in the first exemplary embodiment. As compared with the case in which only a one-dimensional vibration is carried out, therefore, it is possible to enhance a capability for breaking the developer more greatly.

(Variant)

Although the embodiments according to the invention have been described above in detail, the invention is not restricted to the embodiments but various changes can be made without departing from the scope of the invention described in the claims. Variants (H01) to (H07) according to the invention will be described below.

(H01) Although the copying machine has been taken as an example of the image forming apparatus in the embodiments, the invention is not restricted thereto but the image forming apparatus can also be constituted by a printer, a FAX or a composite machine having some or all of these functions, for example.

(H02) In the embodiments, the copying machine U is not restricted to the structure in which the toners having four colors are used, and can also be applied to an image forming apparatus using five colors or more, three colors or less, or a single color, for example.

(H03) Although the breaking members 11 and 11' are formed by bending a wire in the embodiments, the invention is not restricted to the structure. The breaking members 11 and 11' can be formed by bending a plate material or coupling plural members.

(H04) Although the breaking members 11 and 11' have the longitudinally symmetrical structures in the embodiments, the invention is not restricted to the structures but they can also have transverse asymmetrical configurations. For example, it is also possible to propose that a front side is set to have the shape of the breaking member 11 according to the first exemplary embodiment and a rear side is set to have the shape of the breaking member 11' according to the second exemplary embodiment. In case of a structure in which a developer grows like a lump at a front side, for example, it is also possible to employ a structure in which only a front breaking portion and a front contact portion are provided and a rear breaking portion and a rear contact portion are omitted, or a support is not carried out by the supported portions 12*c* and 13*c* but the rear breaking portion 13 of the breaking members 11 and 11' to vibrate only the front breaking portion 12.

(H05) Although there has been described, as the image forming apparatus, the structure of the so-called large-sized machine which can be divided into the image inputting device U1, the medium supplying device U2, the image forming apparatus body U3 and the paper processing device U4 in the embodiments, the invention is not restricted to the structure but can be applied to the so-called middle-sized or small-sized machine. Moreover, it is also possible to employ a structure in which an attachable and separable device is further present. To the contrary, it is possible to employ an optional structure, for example, a structure in which the image inputting device U1 and the medium supplying device U2 are integrated and cannot separate from each other.

(H06) Although it is desirable that the length L1 and the interval L2 should be set as illustrated in the embodiments, it is also possible to set them differently.

(H07) Although the auger having the rotating shaft 7 and the delivering blade 8 has been described as the delivering member in the embodiments, the invention is not restricted to the structure but it is also possible to employ a coil spring-shaped structure in which a rotating shaft is not provided but only a helical delivering blade is disposed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer delivering device comprising:

a first delivering path through which a developer is delivered;

a second delivering path through which the developer is delivered, the second delivering path being disposed on a downstream of the first delivering path;

a helical delivering blade that is disposed in the second delivering path and delivers the developer by a rotation; and a developer breaking member that is disposed in a connecting portion of the first delivering path and the second delivering path and includes a breaking portion that is disposed opposite to a side wall of the second delivering path in a developer delivering direction of the second delivering path, a contact portion that is in contact with the helical delivering blade and extended in the developer delivering direction between the breaking portion and a center of the rotation of the helical delivering blade, and a coupling portion, the breaking portion having a first breaking portion disposed opposite to one of the side walls of the second delivering path, and a second breaking portion disposed opposite to the other side wall of the second delivering path, the contact portion having a first contact portion extended in the developer delivering direction between the first breaking portion and the center of the rotation of the delivering blade, and a second contact portion extended in the developer delivering direction between the second breaking portion and the center of the rotation of the delivering blade, the coupling portion coupling the first contact portion to the second contact portion, wherein the first breaking portion and the second breaking portion are fixed and supported on the developer delivering path at an upstream end in the developer delivering direction of the second delivering path, and the coupling portion that couples upstream ends in the developer delivering direction of the second delivering path of the first contact portion and the second contact portion, and wherein the developer breaking member further includes a first connecting portion that connects downstream ends in the developer delivering direction of the second delivering path of the first breaking portion and the first contact portion, and a second connecting portion that connects downstream ends in the developer delivering direction of the second delivering path of the second breaking portion and the second contact portion, wherein the contact portion has an approaching tilt portion that is tilted in a direction to approach the helical delivering blade side as compared with the breaking portion, and a separating tilt portion that is provided on a downstream side in the developer delivering direction of the approaching tilt portion and is tilted in a direction to separate from the delivering blade, and an interval between the downstream end in the developer delivering direction of the second delivering path in the breaking portion and an end on the helical delivering blade side of the approaching tilt portion in a direction to approach the center of the rotation of the delivering blade from the breaking portion is smaller than a radius of a rotation from the center of the rotation of the delivering blade.

2. The developer delivering device according to claim 1, wherein the coupling portion is extended to a reverse side to a direction to approach the helical delivering blade as compared with the contact portion.

3. The developer delivering device according to claim 1, wherein the developer breaking member is made from an elastic member that is elastically deformable.

4. A developer delivering device comprising:

a first delivering path through which a developer is delivered;

a second delivering path through which the developer is delivered, the second delivering path being disposed on a downstream of the first delivering path;

a helical delivering blade that is disposed in the second delivering path and delivers the developer by a rotation; and a developer breaking member that is disposed in a connecting portion of the first delivering path and the second delivering path and includes a breaking portion that is disposed opposite to a side wall of the second delivering path in a developer delivering direction of the second delivering path, a contact portion that is in contact with the helical delivering blade and extended in the developer delivering direction between the breaking portion and a center of the rotation of the helical delivering blade, and a coupling portion, the breaking portion having a first breaking portion disposed opposite to one of the side walls of the second delivering path, and a second breaking portion disposed opposite to the other side wall of the second delivering path, the contact portion having a first contact portion extended in the developer delivering direction between the first breaking portion and the center of the rotation of the delivering blade, and a second contact portion extended in the developer delivering direction between the second breaking portion and the center of the rotation of the delivering blade, the coupling portion coupling the first contact portion to the second contact portion, wherein the contact portion has an approaching tilt portion that is tilted in a direction to approach the helical delivering blade side as compared with the breaking portion, and a separating tilt portion that is provided on a downstream side in the developer delivering direction of the approaching tilt portion and is tilted in a direction to separate from the delivering blade, and a length in the developer delivering direction in a region in which the contact portion is protruded toward the helical delivering blade side from the breaking portion is set to be a length in which the approaching tilt portion comes in contact with the helical delivering blade on an upstream side before the separating tilt portion separates from the helical delivering blade.

5. The developer delivering device according to claim 4, wherein the coupling portion is extended to a reverse side to the direction to approach the helical delivering blade as compared with the contact portion.

6. The developer delivering device according to claim 4, wherein the developer breaking member is made from an elastic member that is elastically deformable.

7. A developer delivering device comprising:

a first delivering path through which a developer is delivered;

a second delivering path through which the developer is delivered, the second delivering path being disposed on a downstream of the first delivering path;

a helical delivering blade that is disposed in the second delivering path and delivers the developer by a rotation; and a developer breaking member that is disposed in a connecting portion of the first delivering path and the second delivering path and includes a breaking portion that is disposed opposite to a side wall of the second delivering path in a developer delivering direction of the second delivering path, a contact portion that is in contact with the helical delivering blade and extended in the developer delivering direction between the breaking portion and a center of the rotation of the helical delivering blade, and a coupling portion, the breaking portion having a first breaking portion disposed opposite to one of the side walls of the second delivering path, and a second breaking portion disposed opposite to the other side wall of the second delivering path, the contact portion having a first contact portion extended in the developer delivering direction between the first breaking portion and the center of the rotation of the delivering blade, and a second contact portion extended in the developer delivering direction between the second breaking portion and the center of the rotation of the delivering blade, the coupling portion coupling the first contact portion to the second contact portion, wherein a length in the developer delivering direction in a region in which the contact portion is protruded toward the helical delivering blade side from the breaking portion is set to be a length in which an approaching tilt portion comes in contact with the helical delivering blade on an upstream side before a separating tilt portion separates from the helical delivering blade.

8. The developer delivering device according to claim 7, wherein the coupling portion is extended to a reverse side to the direction to approach the helical delivering blade as compared with the contact portion.

9. The developer delivering device according to claim 7, wherein the developer breaking member is made from an elastic member that is elastically deformable.

10. An image forming apparatus comprising:

an image holding member on which a latent image is formed;

a developing unit that develops the latent image on a surface of the image holding member into a visible image;

a transferring part that transfers the visible image on the surface of the image holding member onto a medium;

a cleaning device that collects and cleans away a residue remaining on the surface of the image holding member to which the visible image is transferred; and a developer delivering device that delivers a developer collected by the cleaning device, the developer delivering device including a first delivering path through which the developer is delivered, a second delivering path through which the developer is delivered, the second delivering path being disposed on a downstream of the first delivering path, a helical delivering blade that is disposed in the second delivering path and delivers the developer by a rotation, and a developer breaking member that is disposed in a connecting portion of the first delivering path and the second delivering path and includes a breaking portion that is disposed opposite to a side wall of the second delivering path in a developer delivering direction of the second delivering path, a contact portion that is in contact with the helical delivering blade and extended in the developer delivering direction between the breaking portion and a center of the rotation of the helical delivering blade, and a coupling portion, the breaking portion having a first breaking portion disposed opposite to one of the side walls of the second delivering path, and a second breaking portion disposed opposite to the other side wall of the second delivering path, the contact portion having a first contact portion extended in the developer delivering direction between the first breaking portion and the center of the rotation of the delivering blade, and a second contact portion extended in the developer delivering direction between the second breaking portion and the center of the rotation of the delivering blade, the coupling portion coupling the first contact portion to the second contact portion, wherein the first breaking portion and the second breaking portion are fixed and supported on the developer delivering path at an upstream end in the developer delivering direction of the second delivering path, and the coupling portion that couples upstream ends in the developer delivering direction of the second delivering path of the first contact portion and the second contact portion, and wherein the developer breaking member further includes a first connecting portion that connects downstream ends in the developer delivering direction of the second delivering path of the first breaking portion and the first contact portion, and a second connecting portion that connects downstream ends in the developer delivering direction of the second delivering path of the second breaking portion and the second contact portion, wherein the contact portion has an approaching tilt portion that is tilted in a direction to approach the helical delivering blade side as compared with the breaking portion, and a separating tilt portion that is provided on a downstream side in the developer delivering direction of the approaching tilt portion and is tilted in a direction to separate from the delivering blade, and an interval between the downstream end in the developer delivering direction of the second delivering path in the breaking portion and an end on the helical delivering blade side of the approaching tilt portion in a direction to approach the center of the rotation of the delivering blade from the breaking portion is smaller than a radius of a rotation from the center of the rotation of the delivering blade.

11. The image forming apparatus according to claim 10, wherein the transferring part has an intermediate transferring member disposed opposite to the image holding member, a primary transferring device that transfers the visible image on the surface of the image holding member onto the intermediate transferring member, a secondary transferring device that transfers, onto a medium, the visible image on a surface of the intermediate transferring member, and an intermediate transferring member cleaning device that collects a residue remaining on the surface of the intermediate transferring member after the transfer onto the medium, the first delivering path through which the residue collected by the intermediate transferring member cleaning device is delivered, and the second delivering path through which the residue collected by the cleaning device of the image holding member is delivered.

12. The image forming apparatus according to claim 10, wherein the transferring part has an intermediate transferring member disposed opposite to the image holding member, a primary transferring device that transfers the visible image on the surface of the image holding member onto the intermediate transferring member, a secondary transferring device that transfers, onto a medium, the visible image on a surface of the intermediate transferring member, and an intermediate transferring member cleaning device that collects a residue remaining on the surface of the intermediate transferring member after the transfer onto the medium, the first delivering path through which the residue collected by the intermediate transferring member cleaning device is delivered, and the second delivering path through which the residue collected by the cleaning device of the image holding member is delivered.

13. A developer delivering device comprising:

a first delivering path through which a developer is delivered;

a second delivering path through which the developer is delivered, the second delivering path being disposed on a downstream of the first delivering path;

a helical delivering blade that is disposed in the second delivering path and delivers the developer by a rotation;

a developer breaking member that is disposed in a connecting portion of the first delivering path and the second delivering path and includes a breaking portion that is disposed opposite to a side wall of the second delivering path in a developer delivering direction of the second delivering path, a contact portion that is in contact with the helical delivering blade and extended in the developer delivering direction between the breaking portion and a center of the rotation of the helical delivering blade, and a coupling portion, the breaking portion having a first breaking portion disposed opposite to one of the side walls of the second delivering path, and a second breaking portion disposed opposite to the other side wall of the second delivering path, the contact portion having a first contact portion extended in the developer delivering direction between the first breaking portion and the center of the rotation of the delivering blade, and a second contact portion extended in the developer delivering direction between the second breaking portion and the center of the rotation of the delivering blade, the coupling portion coupling the first contact portion to the second contact portion, and wherein the coupling portion is extended to a reverse side to a direction to approach the helical delivering blade as compared with the contact portion.

* * * * *